United States Patent [19]

Steiner

[11] Patent Number: 4,587,996

[45] Date of Patent: May 13, 1986

[54] WEFT YARN CONTROL FOR A WEAVING MACHINE ROTOR

[75] Inventor: Alois Steiner, Rieden, Switzerland

[73] Assignee: Sulzer Brothers Limited, Winterthur, Switzerland

[21] Appl. No.: 687,178

[22] Filed: Dec. 28, 1984

[30] Foreign Application Priority Data

Jan. 7, 1984 [EP] European Pat. Off. ..... 84100092.0

[51] Int. Cl.[4] ..... D03D 49/70

[52] U.S. Cl. ..... 139/194; 139/302; 139/429; 139/11

[58] Field of Search ..... 139/11 R, 11 A, 28, 139/194, 302, 429

[56] References Cited

U.S. PATENT DOCUMENTS

| | | | |
|---|---|---|---|
| 3,456,342 | 7/1969 | Golobart | 139/302 |
| 3,658,098 | 4/1972 | Mullekom | 139/194 |
| 3,792,723 | 2/1974 | Titov | 139/302 |
| 4,071,051 | 1/1978 | Strauss | 139/194 |

*Primary Examiner*—Henry S. Jaudon

*Attorney, Agent, or Firm*—Kenyon & Kenyon

[57] ABSTRACT

The weft yarn control employs a weft clamping and severing device on each of the picking side and catching side of the weaving rotor. Each device includes a suction tube into which the end of the weft yarn can be drawn, a spring for guiding a weft yarn end between the spring and suction tube and a clamping lever for clamping the yarn when severing is to take place. In addition, each device has a pair of blades for cutting the exposed end of a weft yarn prior to beating-up so that the excess yarn can be drawn off through the suction tubes.

10 Claims, 6 Drawing Figures

WEFT YARN CONTROL FOR A WEAVING MACHINE ROTOR

This invention relates to a weft yarn control for a weaving machine rotor. More particularly, this invention relates to a weft yarn control for a weaving rotor in a weaving machine of the series shed type.

Heretofore, it has been known to construct weaving machines with a weaving rotor on which a series of spaced apart picking combs and beat-up combs are mounted in alternating manner. In such cases, a weft yarn has been picked into each picking comb and sequentially beaten-up by the trailing beat-up comb during rotation of the weaving rotor. Generally, after a weft yarn has been picked and severed on the picking side, the yarn has to be retained at the ends which project from both sides of the rotating weaving rotor until the time of beating-up into a fabric.

Accordingly, it is an object of the invention to provide a relatively simple means for retaining the ends of a weft yarn on a rotating weaving rotor for subsequent beating-up into a fabric.

It is another object of the invention to provide a reliable control for holding the ends of a weft yarn on a weaving rotor.

Briefly, the invention provides a weft yarn control for controlling a weft yarn which is picked into a shed which moves with a weaving rotor in a series-shed type weaving machine. This yarn control includes a pair of weft clamping and severing devices each of which is disposed on a respective side of the rotor, that is, one on the picking side and one on the catching side of the rotor.

In accordance with the invention, the weft clamping and severing device on the picking side of the rotor includes a suction tube which has a longitudinally extending groove disposed tranversely of the picking direction and a longitudinally extending gap disposed transversely of the groove to draw air into the tube, a spring which is secured to the tube between the groove and the rotor and which extends over the length of the groove in resilient engagement with the tube and a weft clamping lever for movement into the groove in order to clamp a weft yarn therein. In addition, a severing means is mounted on the tube for severing a weft yarn. This severing means includes a first blade connected to the clamping lever and a second blade disposed on the suction tube adjacent to the first blade for severing a weft yarn therebetween.

The weft clamping and severing device on the catching side of the rotor is constructed in similar fashion but is disposed in mirror image relationship.

The clamping and severing devices function so as to hold the ends of a weft yarn which has been picked into a picking comb on the weaving rotor prior to beating-up into a fabric. To this end, as a picked yarn arrives at the catching side of the rotor, the free end is drawn into the longitudinally extending gap of the suction tube thereat while the ends of the yarn extending from each side of the rotor are moved transversely between the spring and suction tube of each clamping and severing device. As the rotor continues to move, the yarn ends are slid along between the spring and suction tube until the clamping levers are actuated. At this time, with the yarn ends clamped, the weft yarn can be cut from the supply by a suitable severing means upstream of the device on the picking side. The free end of the picked weft yarn which thus occurs is then drawn into the gap of the suction tube at the picking side.

With the free yarn ends each held in a respective suction tube, the clamping levers can be released as the weaving rotor continues to rotate. In this condition, the weft yarn is moved into the beat-up point of the weaving machine and beaten-up by a following beating-up comb. At this point, the severing means of the clamping and severing devices sever the exposed ends of the weft yarn and these ends can be drawn off through the respective suction tubes.

These and other objects and advantages of the invention will become more apparent from the following detailed description taken in conjunction with the accompanying drawings wherein.

Figure 1:
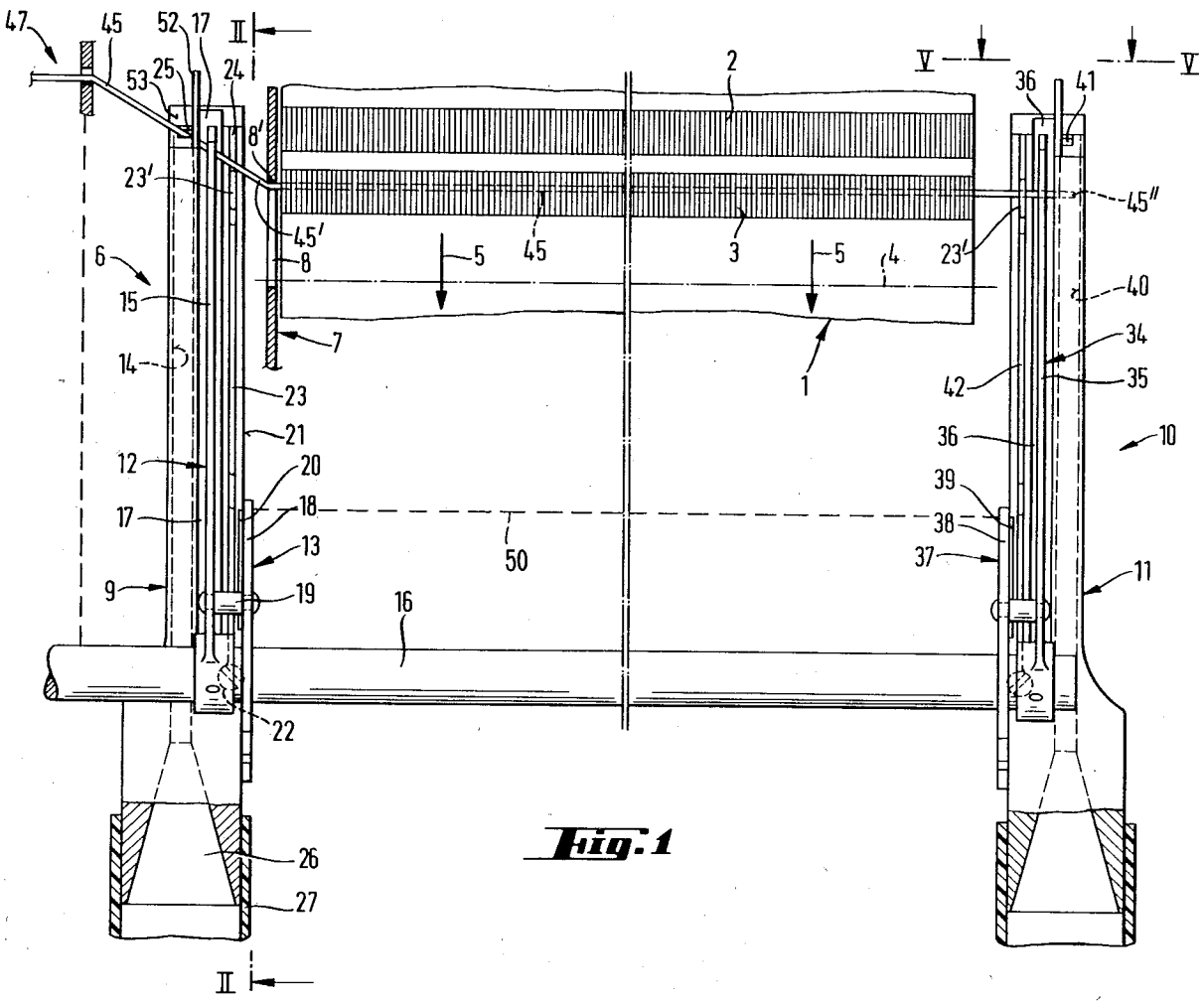
FIG. 1 illustrates a front view of a weft yarn control according to the invention.

Referring to FIG. 1, a weaving rotor 1 is provided with a plurality of beating-up combs 2 and picking combs 3 which are disposed in alternating relationship with each other on the periphery of the rotor 1. As indicated, the rotor 1 is rotatable around a longitudinal axis 4 and is driven in the direction indicated by the arrows 5 by suitable means of a series-shed type weaving machine. In addition, a weft entraining ring 7 is disposed on the picking side 6 of the rotor 1. As indicated in FIGS. 1 and 2, the ring 7 is formed with a weft guide aperture 8 opposite each picking comb 3.

A weft yarn control is provided for controlling a weft yarn 45 which is picked into a picking comb 3 within a shed which moves with the rotor 1. This control includes a pair of clamping and severing devices 9, 10 which are disposed on a respective side of the rotor. As indicated, one clamping and severing device 9 is disposed on the picking side 6 of the rotor while the other device 11 is disposed on the catching side 10 of the rotor 1.

Figure 2:
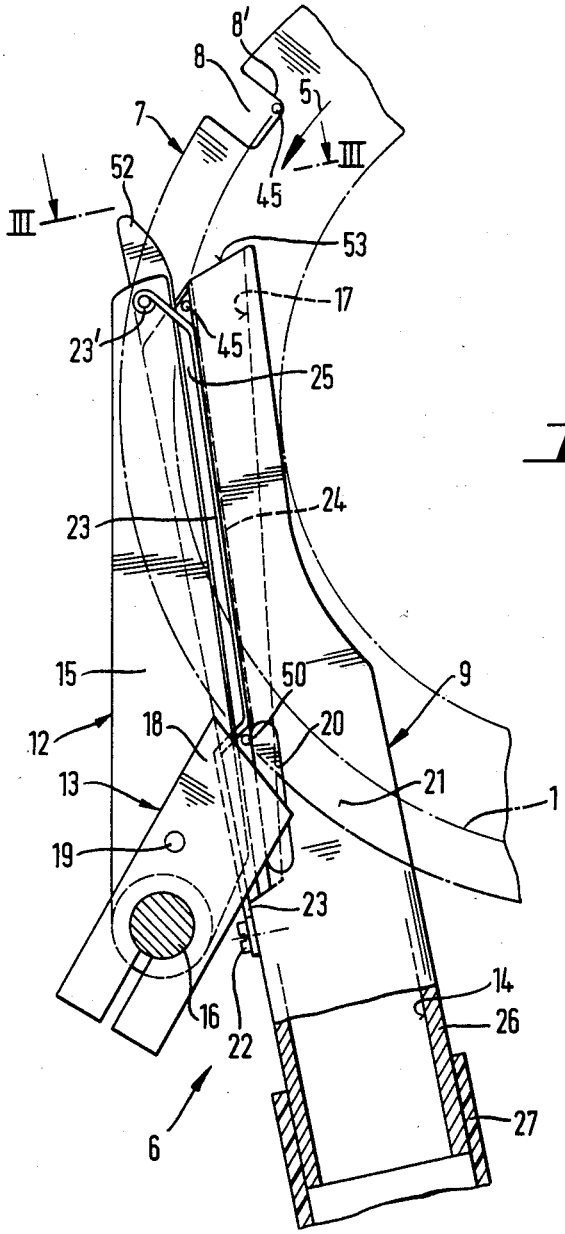
FIG. 2 illustrates a view taken on line II—II of FIG. 1.
Figure 3:
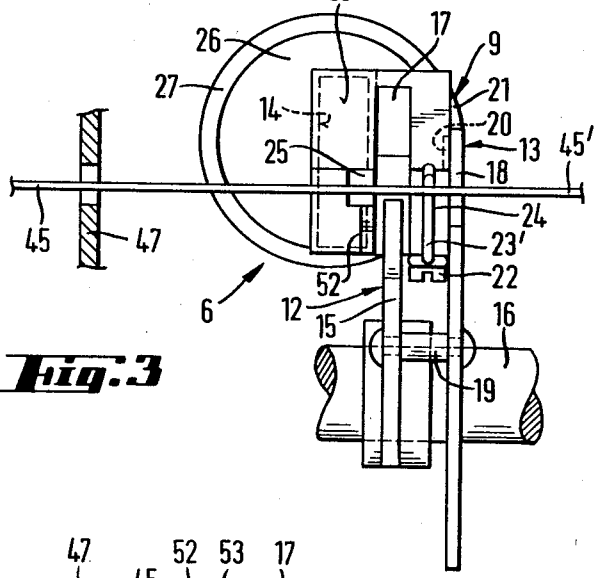
FIG. 3 illustrates a plan view taken on line III—III of FIG. 2.
Figure 4:
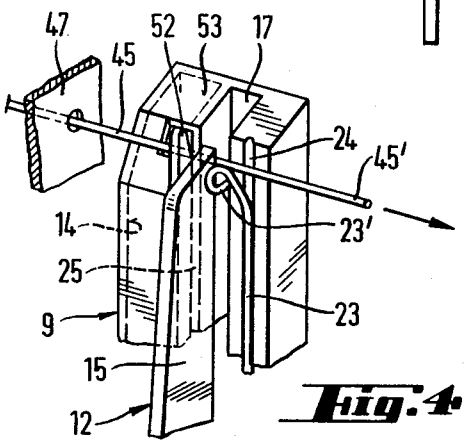
FIG. 4 illustrates a perspective view of the upper end of a clamping and severing device according to the invention.

Referring to FIGS. 1, 2, and 3, the weft clamping and severing device on the picking side 6 includes an elongated section tube 14 which has an internal passage for a flow of air. As indicated in FIG. 2, the lower end of the tube 14 terminates in a suction connection 26 which is connected to a hose 27 which leads to a suitable negative pressure or suction source (not shown). In addition, the suction tube 14 has a longitudinally extending groove 17 adjacent to the internal passage as well as a longitudinally extending gap 25 which communicates the internal passage with the groove 17 in order to permit a flow of air to be drawn from the groove 17 into the internal passage. As indicated in FIG. 4, the gap 25 extends along the suction tube 14 and terminates at the upper end in an opening aligned with the incoming weft yarn 45.

The device 9 also includes a spring 23 which is mounted on and which extends longitudinally along the tube 14. As indicated in FIGS. 2 and 3, the spring 23 is secured to the tube 14 by a screw 22 and is shaped so as to be resiliently biased against the suction tube. As indicated in FIG. 4, a groove 24 may be formed in the suction tube 14 to receive the spring 23. Further, the top end 23' of the spring 23 may be bent away from the tube 14 so as to stand clear of the groove 24. The spring 23 may also be mounted so as to be vertically adjustable relative to the suction tube 14 so that the length by which the spring 23 bears or engages against the suction tube 14 can be adjustable.

As shown in FIG. 2, the spring 23 is shaped so as to guide a transversely extending weft yarn between the spring 23 and suction tube 14 from a point at the free end of the tube 14 to an intermediate point of the tube upstream of a beating-up point.

The device 9 also has a clamp 12 in the form of a clamping lever 15 which is mounted on an actuating shaft 16 for movement into the clamping groove 17 in order to clamp a transversely extending weft yarn 45 therein.

The device 9 also has a severing means 13 for severing a weft yarn at an intermediate point downstream of the beating-up point. This severing means 13 includes a first blade 18 which is connected to the lever 15 via a pin 19 (see FIG. 1) and a second blade 20 which is disposed on the tube 14 adjacent the first blade 18 for severing a weft yarn therebetween. As indicated in FIG. 2, the second blade 20 is secured to one side 21 of the tube 14.

Referring to FIGS. 2 and 4, the upper end of the device 9 includes a pair of fingers 52,53 for guiding a weft yarn 45 into an area defined by the upper end of the spring 23 and the upper end of the suction tube 14. One finger 52 is integrally formed on the suction tube 14 adjacent to the upper end of the gap 25 as indicated in FIG. 3 while the other finger 53 is formed as a sloped surface on the upper end of the suction tube 14.

As indicated in FIG. 1, the weft yarn 45 is delivered via a second severing means 47 in the form of a shear.

Figure 5:
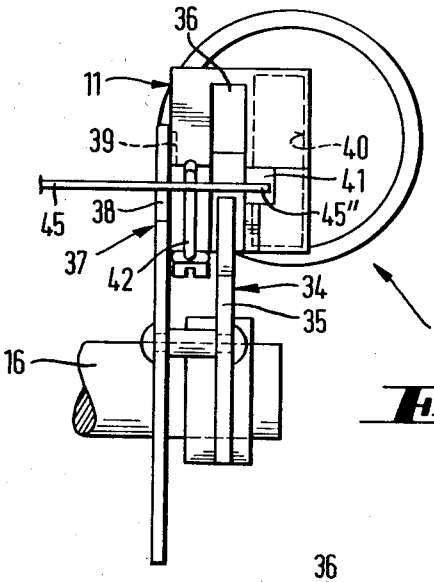
FIG. 5 illustrates a plan view taken on line V—V of FIG. 1.
Figure 6:
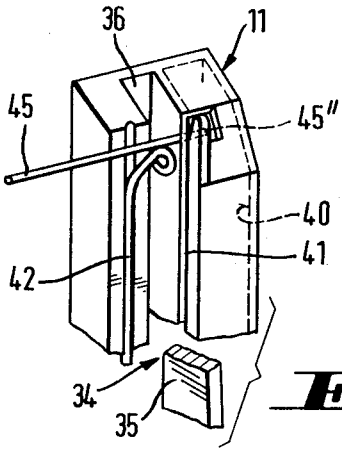
FIG. 6 illustrates a perspective view of the upper end of the weft clamping and severing device of FIG. 5.

Referring to FIGS. 1, 5 and 6, the weft clamping and severing device 11 located on the catching side 10 of the rotor 1 is of identical construction to the device 9 except that the device 11 is laterally inverted in relation thereto, i.e. is in mirror image relationship. In this regard, the device 11 employs a clamp 34 in the form of a clamping lever 35 which cooperates with a clamping groove 36, a severing means 37 which includes a pair of blades 38,39, a suction tube having an internal passage 40, a suction gap 41 communicating the passage 40 with the clamping groove 36 and a wire spring 42. As above, the clamping lever 35 is secured to the actuating shaft 16 and is oscillated at the cadence of the weaving machine by a cam (not shown) which is driven by a main shaft (not shown) of the machine.

The weft yarn control operates as follows.

First, it is assumed that a weft yarn 45 has been introduced into the picking comb 3 by a picking device (not shown) on the picking side 6 of the machine and that the weft yarn 45 is moving with the assistance of relay nozzles (not shown) towards the catching end of the rotor 1. The weft yarn 45 thus passes through the severing means 47 which is also actuated by the shaft 16. As indicated in FIGS. 1 and 2, the weft yarn 45 engages against a back wall 8' of the guide aperture 8 and the ring 7 so as to be carried towards a beating-up point 50 (FIG. 2). Just before the weft yarn 45 reaches the clamping and severing device 9 on the picking side, the yarn 45 issues on the catching side 10 of the rotor.

As the rotor 1 continues to rotate, the trailing end 45' is guided by the fingers 52,53 into the clamping and severing device 9 (see FIG. 4) while the forward free end 45" extends into the clamping and severing device 11 (see FIG. 6). At this time, the trailing end 45' bridges transversely across the clamping groove 17 within the plane of the clamping lever 15. The forward weft end 45" likewise bridges the clamping groove 36 in spaced relation to the clamping lever 35 and extends into the gap 41 which keeps the end of the weft yarn 45 taut.

As the rotor 1 continues to move, the shaft 16 moves the two clamping levers 15, 35 forwardly to press each into the respective clamping grooves 17, 36. The respective yarn ends 45', 45" are thus pressed onto the groove base and each forms a loop. Immediately afterwards, the shaft 16 actuates the severing means 47 to sever the weft yarn 45. At this time, the trailing end 45' of the weft yarn remains within the gap 25 and the free end 40 of the trailing end 45' is drawn downwardly within the internal passage of the tube 14 towards the terminal end 26.

As the rotor continues to rotate, the springs 23, 42 now retain the weft yarn ends 45', 45". The shaft 16 then moves the levers 15, 35 back so that the yarn clamps 12, 14 open and the rotor 1 guides the yarn 45 below the springs 23, 44 towards an intermediate point of the suction tube 14 corresponding to the beating-up point 50.

When the yarn 45 reaches the beating-up point 50, the beating-up comb 2 which follows the picking comb 3 beats the yarn 45 into the fabric (not shown). The shed then closes and the cloth take-up movement (not shown) of the weaving machine then draws the yarn ends 45',45" away below the wire springs 23, 42. The thus released yarn ends 45', 45" are stretched by the airstream drawn through the respective gaps 25, 41. In this stretched position, the cloth take-up movement guides the yarn ends 45', 45" into the respective severing means 13, 37 for severance thereby. The severed ends are then sucked through the respective gaps 25, 41 into the respective suction tubes 14, 40 and removed.

The next weft yarns are treated in the same way.

The invention thus provides a weft yarn control for a weaving rotor of a series-shed type weaving machine which is of relatively simple and reliable construction. Further, the invention provides a weft clamping and severing device which is able to easily control the end of a weft yarn which is picked into a picking comb of a weaving rotor in a reliable manner.

What is claimed is:

1. In combination, a weaving rotor for a weaving machine;

a weft yarn control for controlling a weft yarn picked into a shed moving with said rotor, said control including a pair of weft clamping and severing devices, each said device being disposed on a respective side of said rotor and including;

a suction tube having a longitudinally extending groove disposed transversely of the picking direction and a longitudinally extending gap disposed transversely of said groove to draw air into said tube;

a weft clamping lever for movement into said groove to clamp a weft yarn therein;

a first blade connected to said lever;

a second blade disposed on said tube adjacent said first blade for severing a weft yarn therebetween; and a spring secured to said tube between said groove and said rotor and extending over the length of said groove in resilient engagement with said tube.

2. The combination as set forth in claim 1 which further includes a common shaft having said lever of each said device mounted thereon for actuation thereby.

3. The combination as set forth in claim 1 wherein said tube has a longitudinally extending second groove and at least some of said spring is disposed in said second groove.

4. The combination as set forth in claim 1 wherein said spring extends along said gap.

5. The combination as set forth in claim 1 wherein said spring is longitudinally adjustable relative to said tube.

6. A weft clamping and severing device comprising an elongated suction tube having an internal passage for a flow of air, a longitudinally extending groove adjacent said passage, and a longitudinally extending gap communicating said passage with said groove to permit a flow of air to be drawn from said groove into said passage;

a spring mounted on and extending longitudinally along said tube to guide a transversely extending weft yarn therebetween from a point at a free end of said tube to an intermediate point of said tube;

a weft clamping lever for movement into said groove to clamp a transversely extending weft yarn therein; and severing means for severing a weft yarn at said intermediate point with the severed end of the weft yarn being drawn into said gap.

7. A weft clamping and severing device as set forth in claim 6 wherein said severing means includes a first blade connected to said lever and a second blade disposed on said tube adjacent said first blade for severing a weft yarn therebetween.

8. A weft clamping and severing device as set forth in claim 6 wherein said spring is secured at one end to said tube and is resiliently biased against said tube.

9. In combination a weaving rotor having at least one picking comb for receiving a weft yarn;

a weft clamping and severing device disposed on a picking side of said rotor and including an elongated suction tube having an internal passage for a flow of air, a longitudinally extending groove adjacent said passage, and a longitudinally extending gap communicating said passage with said groove to permit a flow of air to be drawn from said groove into said passage;

a spring mounted on and extending longitudinally along said tube to guide a transversely extending weft yarn therebetween from a point at a free end of said tube to an intermediate point of said tube;

a weft clamping lever for movement into said groove to clamp a transversely extending weft yarn therein; and severing means for severing a weft yarn at said intermediate point with the severed end of the weft yarn being drawn into said gap; and a second severing means for severing a weft yarn clamped between said lever and said tube upstream of said intermediate point with the severed end of the weft yarn being drawn to said gap.

10. The combination as set forth in claim 9 which further comprises a second weft clamping and severing device disposed on a catching side of said rotor, said second device including an elongated suction tube having an internal passage for a flow of air, a longitudinally extending groove adjacent said passage, and a longitudinally extending gap communicating said passage with said groove to permit a flow of air to be drawn from said groove into said passage;

a spring mounted on and extending longitudinally along said tube to guide a transversely extending weft yarn therebetween from a point at a free end of said tube to an intermediate point of said tube; and severing means for severing a weft yarn at said intermediate point with the severed end of the weft yarn being drawn into said gap.

* * * * *

UNITED STATES PATENT AND TRADEMARK OFFICE

CERTIFICATE OF CORRECTION

PATENT NO. : 4,587,996

DATED : May 13, 1986

INVENTOR(S) : ALOIS STEINER

It is certified that error appears in the above-identified patent and that said Letters Patent is hereby corrected as shown below:

Column 4, line 19 change "end 40 of" to -end of-

Signed and Sealed this

Twentieth Day of January, 1987

*Attest:*

DONALD J. QUIGG

*Attesting Officer*

*Commissioner of Patents and Trademarks*